US005470127A

United States Patent [19]

Kassai et al.

[11] Patent Number: 5,470,127

[45] Date of Patent: Nov. 28, 1995

[54] BABY TABLE CHAIR USABLE AS SHOULDER HARNESS

[75] Inventors: Kenzou Kassai; Keiji Inoue, both of Osaka, Japan

[73] Assignee: Aprica Kassai Kabushikikaisha, Japan

[21] Appl. No.: 164,401

[22] Filed: Dec. 9, 1993

[30] Foreign Application Priority Data

Dec. 9, 1992 [JP] Japan ..... 4-084850 U

[51] Int. Cl.[6] ..... A47B 39/00

[52] U.S. Cl. ..... 297/174; 297/130; 224/161

[58] Field of Search ..... 297/4, 118, 174; 224/155, 153, 160, 161

[56] References Cited

U.S. PATENT DOCUMENTS

| | | | |
|---|---|---|---|
| 3,984,115 | 10/1976 | Miller | 297/130 X |
| 4,322,110 | 3/1982 | Simmons et al. . | |
| 4,747,526 | 5/1988 | Launes | 224/161 X |
| 4,863,216 | 9/1989 | Prescott | 297/174 |
| 4,938,400 | 7/1990 | Springston . | |
| 5,046,651 | 9/1991 | Dagdagan . | |

FOREIGN PATENT DOCUMENTS

| | | | |
|---|---|---|---|
| 2222752 | 11/1973 | Germany | 297/250.1 |
| 3-39093 | 8/1991 | Japan . | |
| 3-39092 | 8/1991 | Japan . | |
| 4-104954 | 9/1992 | Japan . | |

*Primary Examiner*—Laurie K. Cranmer

*Attorney, Agent, or Firm*—Ostrolenk, Faber, Gerb & Soffen

[57] ABSTRACT

Disclosed herein is a baby table chair which is usable as a shoulder harness for carrying a baby. The table chair comprises a chair portion for seating the baby thereon, an arm portion for supporting the chair portion, a pair of shoulder belts which are mounted between the chair portion and the arm portion, and an arm mounting portion for rotatably supporting the arm portion. The arm mounting portion positions and fixes the arm portion in front of the chair portion for holding a table with the arm portion thereby using the table chair as such, and under the chair portion for using the table chair as a shoulder harness.

5 Claims, 17 Drawing Sheets

BABY TABLE CHAIR USABLE AS SHOULDER HARNESS

BACKGROUND OF THE INVENTION

1. Field of the Invention

The present invention relates to a baby table chair, which can be attached to a plate such as a table for seating a baby.

2. Description of the Background Art

A well-known baby table chair is provided with arms for holding a plate such as a table therebetween, so that the same is attached thereto (e.g. Japanese Utility Model Publication No. 4-39092 or 4-39093 (1992), Japanese Utility Model Laying-Open Gazette No. 4-104954 (1992), or the like). Such a table chair is attached to the table when the same is used, and detached from the table and stored in a storage portion when the same is not used.

On the other hand, a shoulder harness having a chair portion for seating a baby thereon is known as an instrument for carrying a baby on the user's back. Such a shoulder harness is not used at all times either, and must be stored in a storage portion when the same is not used.

The table chair and the shoulder harness, which are separately employed for seating a baby at a table and for carrying it on the user's back respectively, are never used for the baby at the same time. Thus, it is necessary to prepare the table chair and the shoulder harness having absolutely different functions independently of each other for a single baby. As hereinabove described, these products must be stored in a storage portion when the same are not used. Considering recent housing circumferences, however, it is difficult to ensure such a storage space. Thus, these convenient products are rather troublesome when the same are not used.

SUMMARY OF THE INVENTION

An object of the present invention is to provide an article which serves both as a baby shoulder harness and a baby table chair.

A baby table chair according to the present invention comprises a chair portion for seating a baby thereon, a fixing portion for fixing the chair portion to a table, and a shoulder belt for carrying the chair portion on the user's back.

A baby table chair according to a first aspect of the present invention comprises a chair portion for seating a baby thereon, an arm portion having an end which is mounted on the chair portion for supporting the same, a shoulder belt having an end which is mounted on the chair portion and another end which is mounted on the arm portion, and an arm mounting portion for mounting the end of the arm portion on the chair portion. The arm mounting portion can rotatably support the arm portion, and implements a state of positioning the arm portion in front of the chair portion for holding a table with the arm portion so that the table chair is used as such, and another state of positioning the arm portion under the chair portion so that the table chair is used as a shoulder harness. Further, this arm mounting portion can locate and fix the arm portion on positions for implementing these two states.

A baby table chair according to a second aspect of the present invention comprises a chair portion, an arm portion, a shoulder belt and an arm mounting portion. This baby table chair can be stood up by the arm portion in a state serving as a shoulder harness.

In each of the first and second aspects of the present invention, the arm portion is not restricted in structure, so far as the same can hold a table to be attached thereto. In relation to this, it is possible to employ a structure which can hold both sides of a table with two arms, as shown in each of the aforementioned gazettes.

According to the present invention, the baby table chair comprises a fixing portion for fixing the chair portion to a table so that the table chair can be used as such through this fixing portion, as well as a shoulder belt for carrying the chair portion on the user's back. The user can carry the chair portion on his back through this shoulder belt, thereby using the table chair as a shoulder harness.

In each of the first and second aspects of the present invention, the arm portion supporting the chair portion is so rotatably supported as to implement a state of positioning the arm portion in front of the chair portion for holding a table with the arm portion so that the table chair is used as such, and a state of positioning the arm portion under the chair portion so that the table chair is used as a shoulder harness. Further, it is possible to locate and fix the arm portion on these positions by the arm mounting portion.

According to the second aspect of the present invention, further, the table chair can be stood up on the floor through the arm portion, when the same is used as a shoulder harness. When the table chair is devised to be stably stood up while seating a baby on the chair portion, it is possible to use the table chair as a chair which is set on the floor.

The table chair according to the present invention can be also used as a shoulder harness as described above, whereby it is not necessary to prepare a table chair and a shoulder harness independently of each other, and the table chair can be suitably applied to a house having only a limited space.

According to the first aspect of the present invention, the arm portion supporting the chair portion is rotatably supported by the arm mounting portion so that the table chair can be used as such in a state positioning the arm portion in front of the chair portion while the same can also be used as a shoulder harness in a state positioning the arm portion under the chair portion. The arm portion can be positioned and fixed in the respective states.

Thus, the table chair can be used as such and as a shoulder harness in a simple structure. The arm portion is positioned and fixed by the arm mounting portion in each state, whereby the inventive baby table chair can be stably used in safety.

According to the second aspect of the present invention, the baby table chair can be stood up by the arm portion in a state serving as a shoulder harness. Thus, the inventive baby table chair can be conveniently used as a shoulder harness. When the table chair is devised to be stably stood up while seating a baby thereon, it is possible to further conveniently carry the baby on the user's back. Further, the table chair can also be used as a table which is set on the floor.

According to the present invention, as hereinabove described, an article serving both as a table chair and a shoulder harness is so provided that the same can be used both as a shoulder harness for carrying a baby on the user's back and as a table chair for seating the baby thereon. In particular, the inventive article is remarkably useful for a modern father who positively contributes to baby care.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
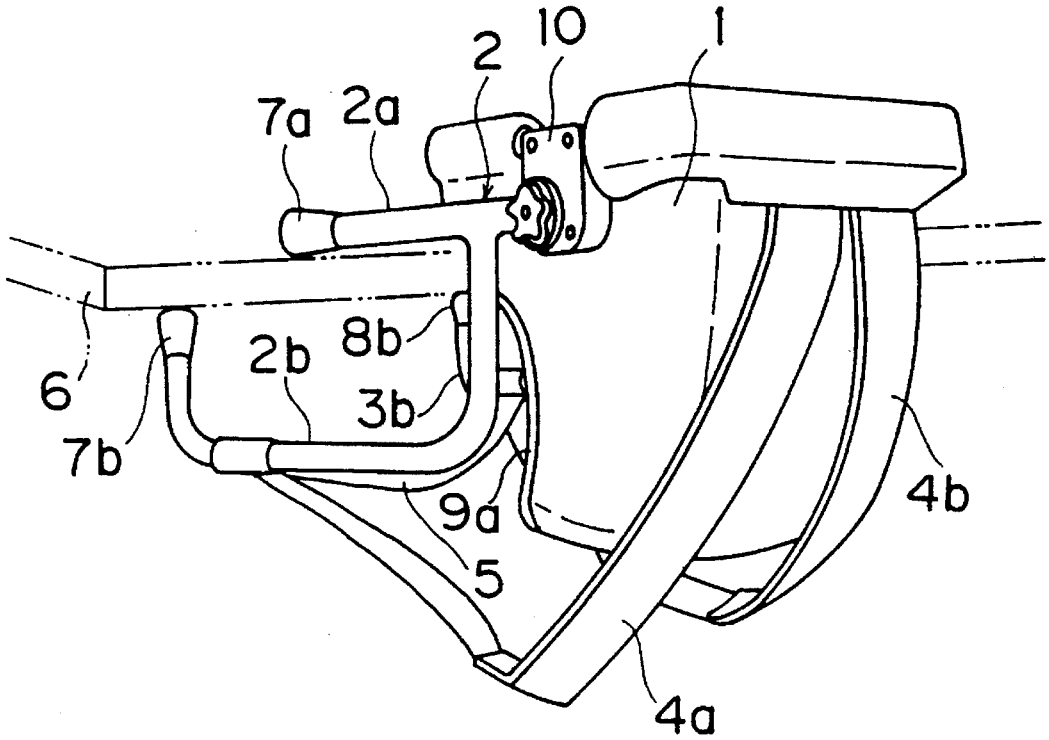
FIG. 1 is a perspective view showing a table chair according to an embodiment of the present invention, which is used as such.
Figure 2:
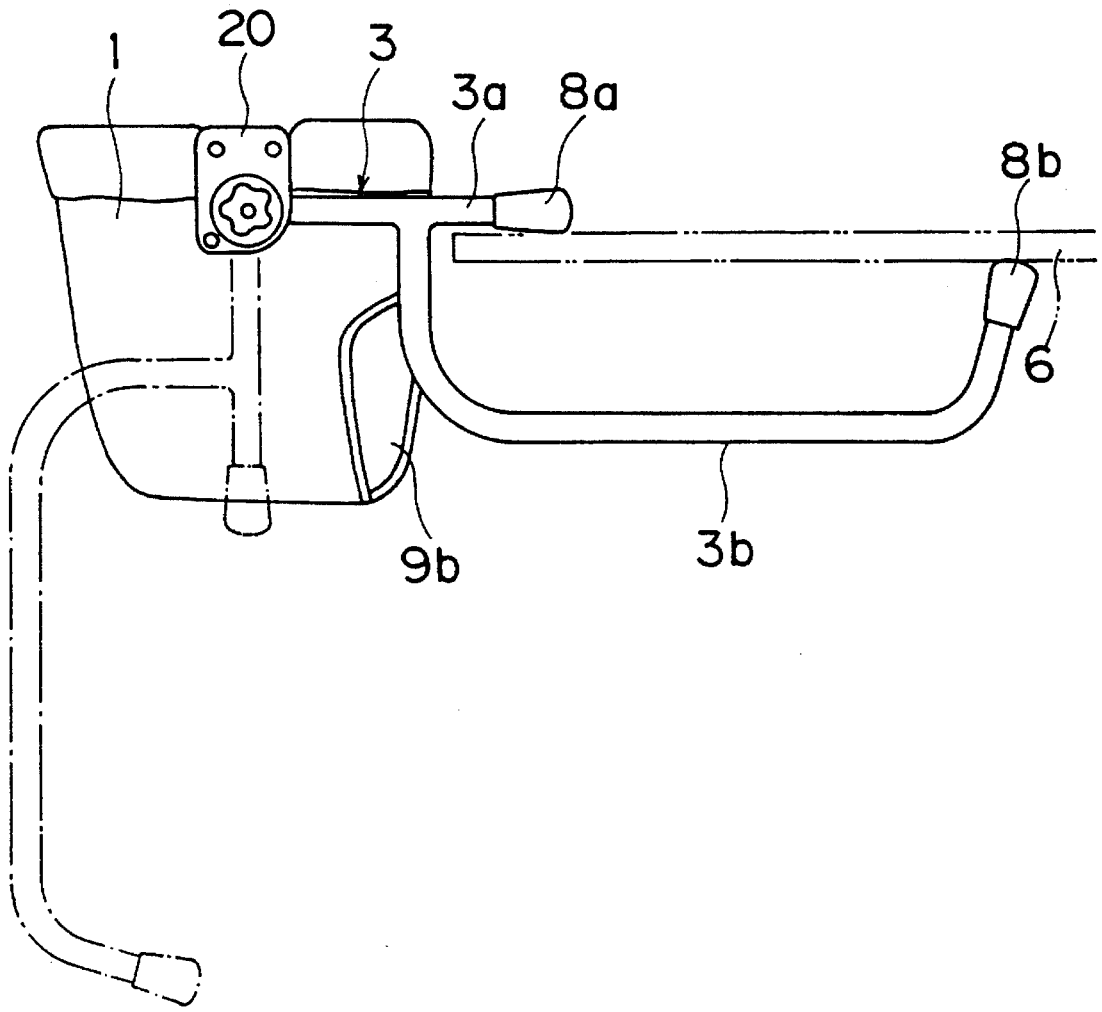
FIG. 2 is a side elevational view showing the table chair according to the embodiment, which is used as such similarly to FIG. 1.

FIG. 1 is a perspective view showing a table chair according to an embodiment of the present invention, which is used as such. FIG. 2 is a side elevational view showing the table chair according to this embodiment. Referring to FIGS. 1 and 2, a chair portion 1 which is made of cloth or the like is supported by a metal frame etc. which is provided on its upper portion. According to this embodiment, a U-shaped metal pipe is so employed that arm mounting portions 10 and 20 are mounted on both side surfaces of a frame of this metal pipe. The chair portion 1 is provided on its front lower portions with openings 9*a* and 9*b* for passing the legs of a baby who is seated on the chair portion 1 therethrough.

Ends of arm portions 2 and 3 are mounted on the arm mounting portions 10 and 20 respectively. These arm portions 2 and 3 are divided in intermediate portions thereof into linearly extending first arms 2*a* and 3*a* and second arms 2*b* and 3*b* which are formed by downwardly, frontwardly and upwardly extending parts. Caps 7*a* and 8*a* of rubber or the like are mounted on forward ends of the first arms 2*a* and 3*a* respectively. Similar caps 7*b* and 8*b* of rubber or the like are also mounted on forward ends of the second arms 2*b* and 3*b* respectively.

A shoulder belt 4*a* is provided between the upper part of the chair portion 1 and a part of the arm portion 2 which is close to the forward end of the second arm 2*b*. Another shoulder belt 4*b* is also mounted between the upper part of the chair portion 1 and a part of the arm portion 3*b* which is close to the forward end of the second arm 3*b*. On the other hand, a waist belt 5 is provided between parts of the arm portions 2 and 3 which are close to the forward ends of the second arms 2*b* and 3*b*.

When this table chair is used as such, the arm portions 2 and 3 are positioned in front of the chair portion 1 as shown in FIGS. 1 and 2, to be attached to a table 6 through the first and second arms 2*a*, 3*a*, 2*b* and 3*b* holding the table 6 therebetween.

As shown in FIG. 2, the arm portion 3 whose end is supported by the arm mounting portion 20 can be rotated about the arm mounting portion 20, to be positioned under the chair portion 1. The other arm portion 2 shown in FIG. 1 can also be rotated about the arm mounting portion 10, to be positioned under the chair portion 1. Thus, the arm portions 2 and 5 are rotated to be positioned under the chair portion 1 and fixed in this state so that the table chair is used as a shoulder harness.

Figure 3:
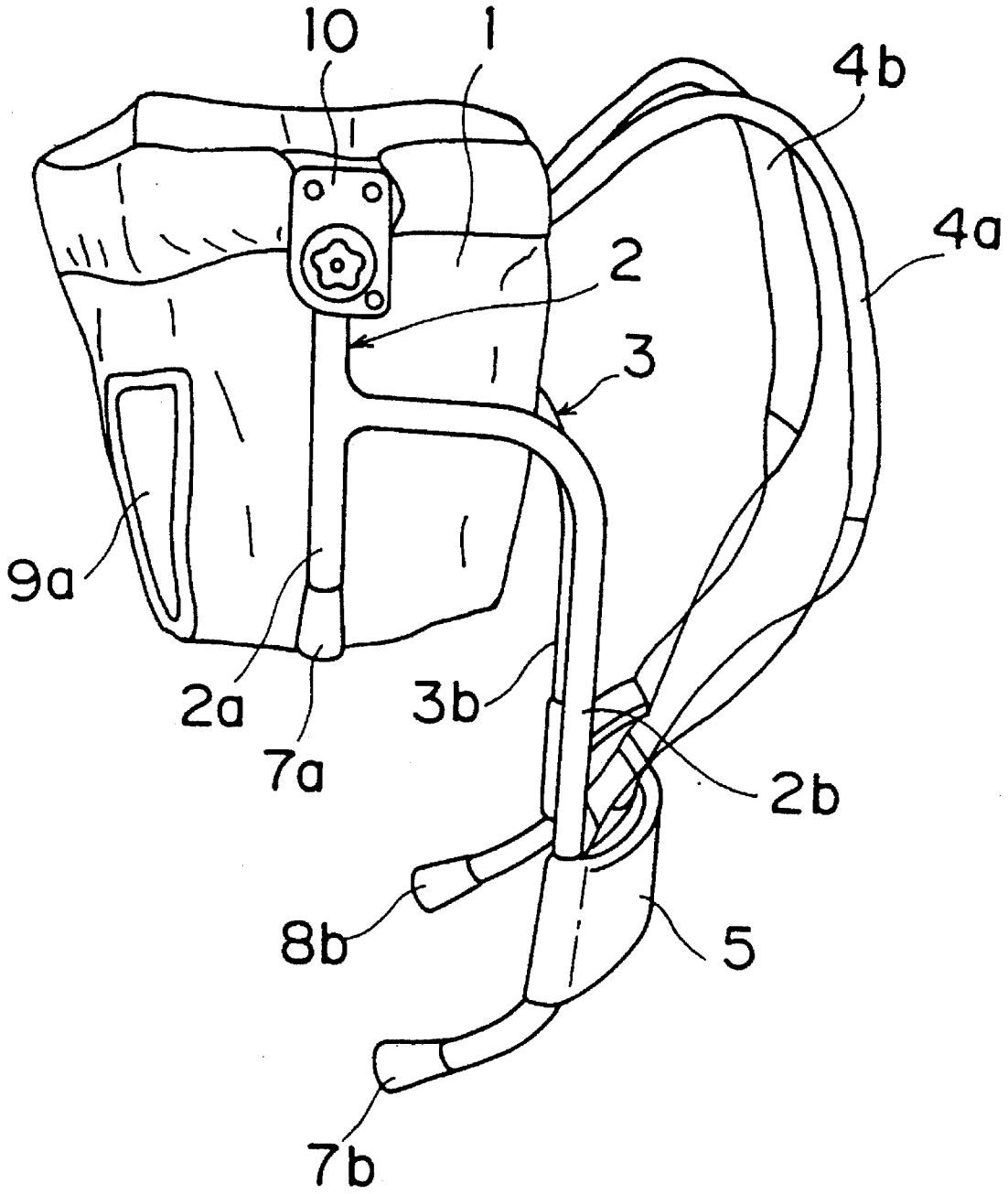
FIG. 3 is a perspective view showing the table chair according to the embodiment, which is used as a shoulder harness.

FIG. 3 is a perspective view showing the table chair which is used as a shoulder harness. Referring to FIG. 3, the arm portions 2 and 3 are downwardly positioned to loosen the shoulder belts 4*a* and 4*b*, thereby allowing the user to carry the shoulder belts 4*a* and 4*b* on his shoulders. The waist belt 5 comes into contact with the user's waist so that he can carry the chair portion 1 on his back, thereby carrying the baby in a back-to-back state.

The table chair according to this embodiment can be used as such and as a shoulder harness, by implementing the two states of positioning the arm portions 2 and 3 in front of and under the chair portion 1 respectively.

Figure 4:
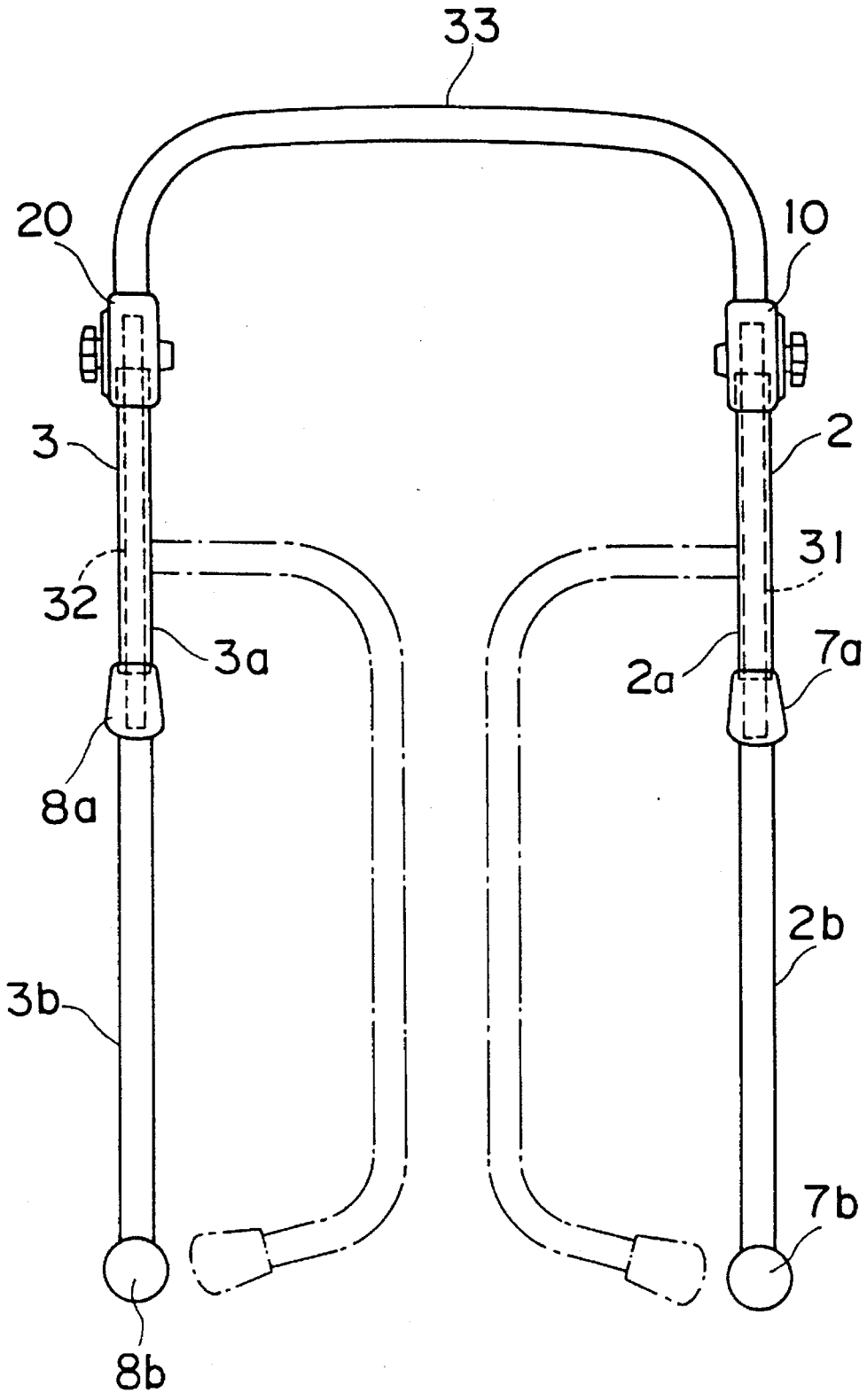
FIG. 4 is a plan view showing an arm portion provided in the table chair according to the embodiment, which is in a stored state.

Further, the table chair according to this embodiment has a compactly storable structure. FIG. 4 is a plan view for illustrating this structure. The chair portion 1, the shoulder belts 4*a* and 4*b* etc. are omitted from FIG. 4. As to a support frame 33 for the chair portion 1, only a part located between the arm mounting portions 10 and 20 is illustrated while the remaining parts are omitted from FIG. 4. As shown in FIG. 4, support pipes 31 and 32 are inserted in the arm portions 2 and 3 respectively, and ends of these support pipes 31 and 32 are fixed to the arm mounting portions 10 and 20. Thus, the arm portions 2 and 3 are rotatable about the support pipes 31 and 32, to inwardly direct the second arms 2*b* and 3*b* as shown by one-dot chain lines in FIG. 4.

Figure 5:
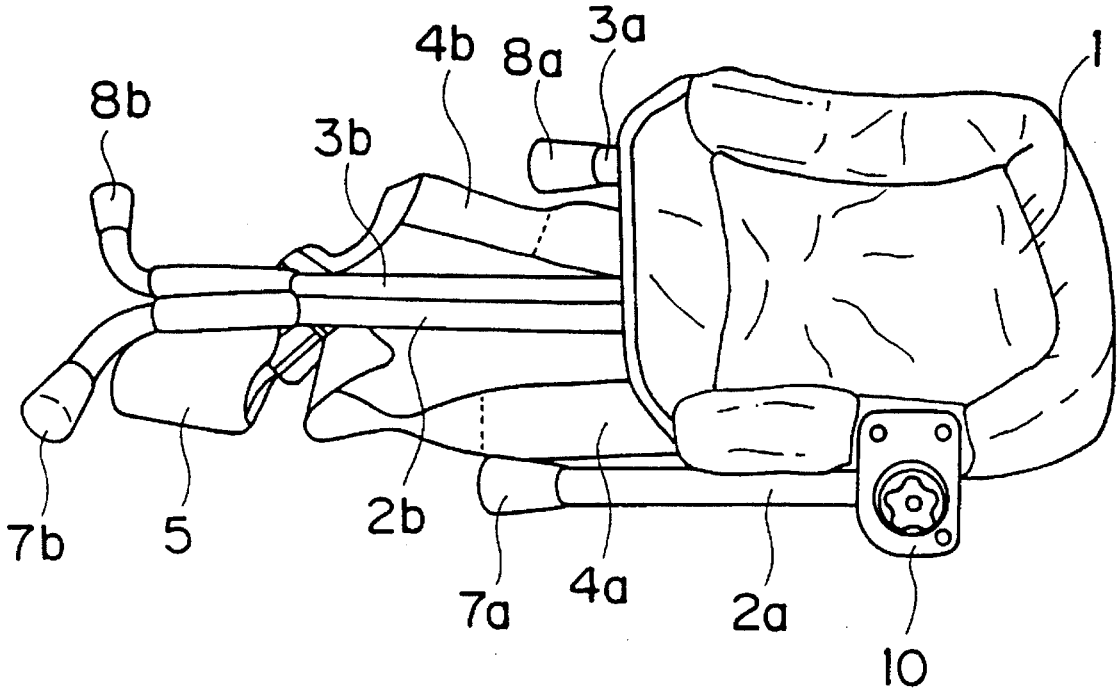
FIG. 5 is a perspective view showing the table chair according to the embodiment, which is in a stored state.

FIG. 5 is a perspective view showing the overall table chair, which is compactly folded by rotating the arm portions 2 and 3 and inwardly directing the second arms 2*b* and 3*b*. As shown in FIG. 5, the table chair according to this embodiment can be folded in a compact state to be stored in a smaller storage portion when the same is not used.

An operating mechanism of each arm mounting portion is now described in further detail.

Figure 6:
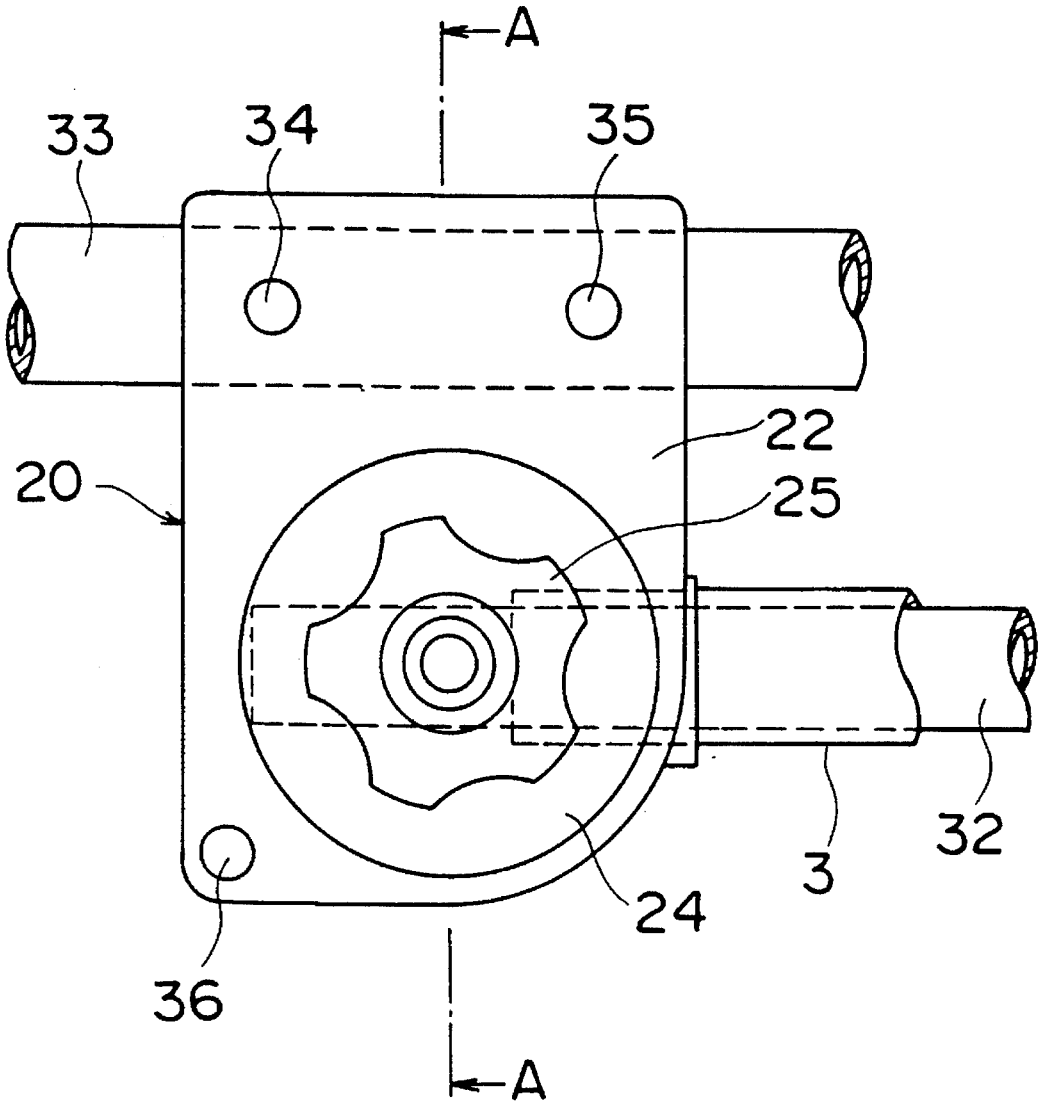
FIG. 6 is a side elevational view showing an arm mounting portion on the table chair according to the embodiment.

FIG. 6 is an enlarged side elevational view showing the arm mounting portion 20. The support frame 33 for the chair portion 1 is passed through an upper part of the arm mounting portion 20. This support frame 33 is mounted on the arm mounting portion 20 by securing pins 34 and 35. Still another securing pin 36 is mounted on a lower part of the arm mounting portion 20. The arm portion 3, which is formed by a metal pipe, is inserted in the arm mounting portion 20, so that the support pipe 32 received in the arm portion 3 is further deeply inserted in the arm mounting portion 20.

Figure 7:
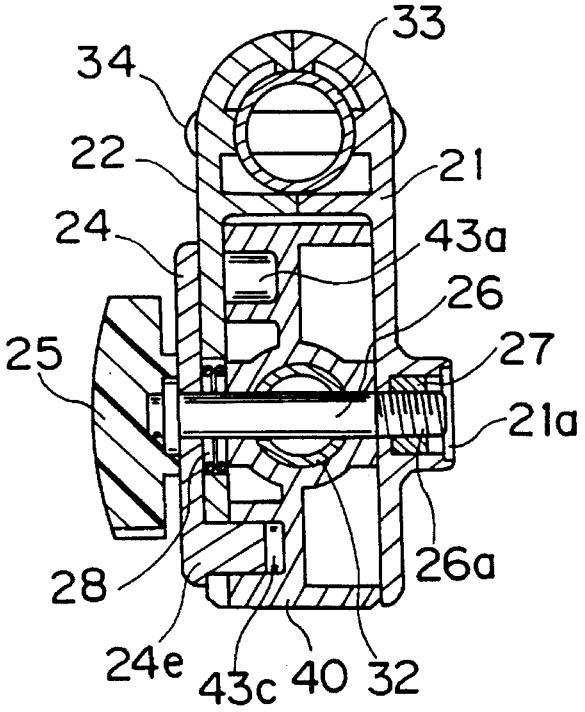
FIG. 7 is a sectional view taken along the line A—A in FIG. 6.

FIG. 7 is a sectional view, taken along the line A—A in FIG. 6, showing the arm mounting portion 20. Referring to FIG. 7, the arm mounting portion 20 is formed by a pair of half cases 21 and 22, a rotary member 40 which is provided in the cases 21 and 22, a stop plate 24 which is mounted on the case 22, and a knob 25 which is provided on the stop plate 24. A shaft 26 is provided on the center of the knob 25, and a bolt portion 26*a* is provided on a forward end of this shaft 26. This bolt portion 26*a* is fitted with a nut 27, which is provided in a hole 21*a* of the case 22.

The rotary member 40 is provided around the shaft 26 which is arranged in the cases 21 and 22. The support pipe 32 is passed through the rotary member 40. A spring 28 is provided around the shaft 26 in a space between the stop plate 24, which is provided on the case 22, and the rotary member 40. This spring 28 urges the stop plate 24 toward the exterior. Referring to FIG. 7, the knob 25 which is provided on the stop plate 24 is rotated clockwise so that the bolt portion 26*a* provided on the forward end of the shaft 26 is fitted with the nut 27 to bring the stop plate 24 into contact with the surface of the case 22.

Figure 8:
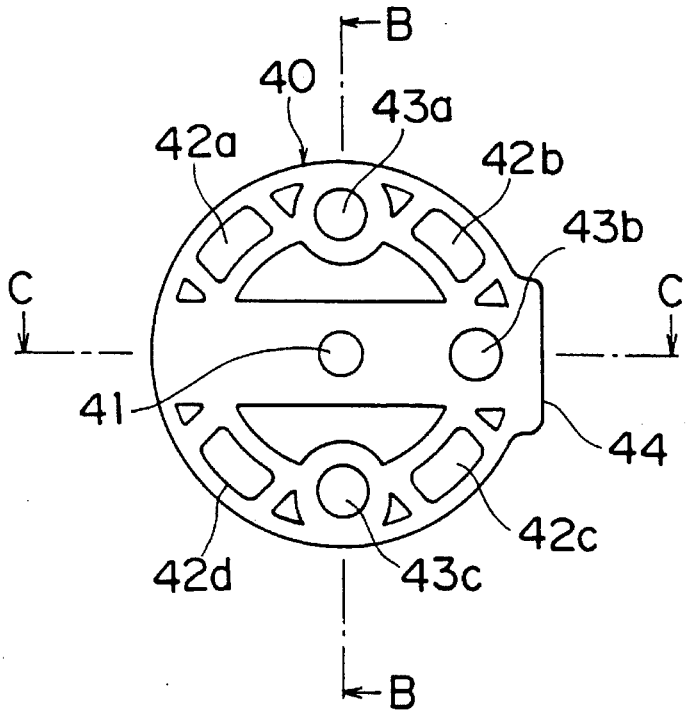
FIG. 8 is a side elevational view showing a rotary member provided in the arm mounting portion.
Figure 9:
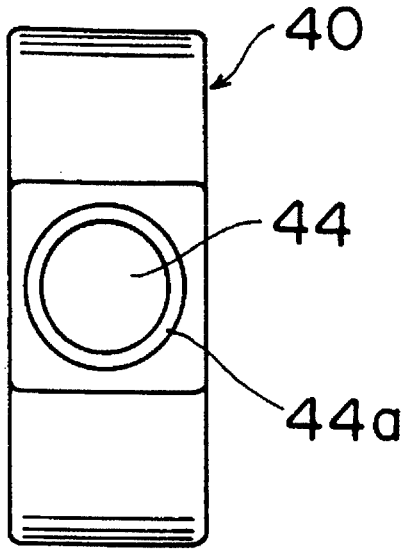
FIG. 9 is a front elevational view showing the rotary member provided in the arm mounting portion.
Figure 10:
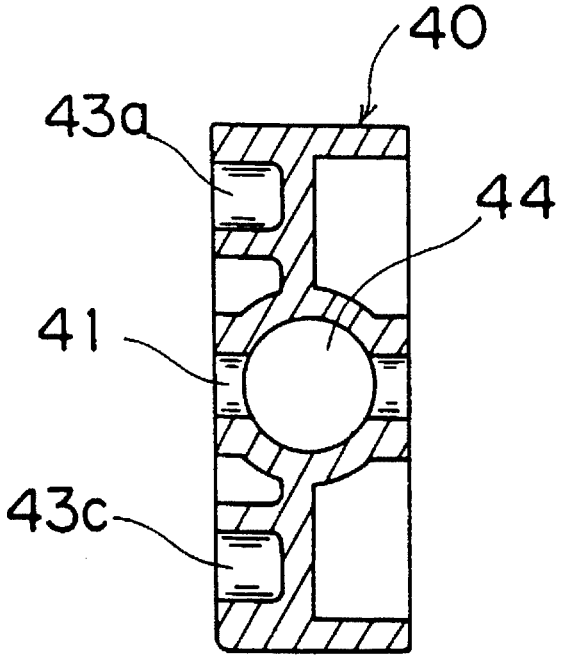
FIG. 10 is a longitudinal sectional view taken along the line B—B in FIG. 8.
Figure 11:
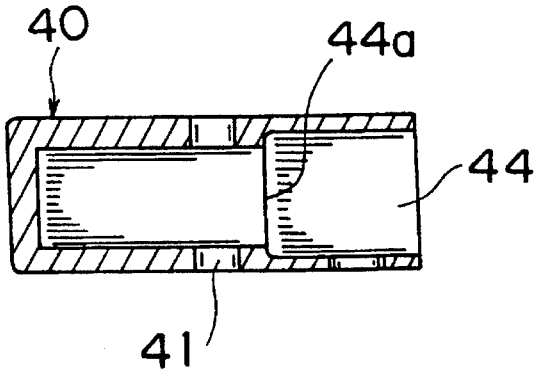
FIG. 11 is a sectional view taken along the line C—C in FIG. 8.

FIG. 8 is a side elevational view showing the rotary member 40. FIG. 9 is a front elevational view of the rotary member 40 as viewed from a pipe receiving hole side. FIG. 10 is a sectional view taken along the line B—B in FIG. 8, and FIG. 11 is a sectional view taken along the line C—C in FIG. 8. Referring to FIGS. 8 to 11, a through hole 41 is formed in the center of the rotary member 40, to receive the shaft 26. Further, angular stop holes 42*a* to 42*d* and circular stop holes 43*a* to 43*c* are formed in a peripheral portion of the rotary member 40. As shown in FIGS. 8 and 10, other holes are also formed in remaining portions of the rotary member 40 in addition to the angular and circular stop holes 42*a* to 42*d* and 43*a* to 43*c* for attaining a rib structure, in order to reduce the weight of the rotary member 40 while maintaining its strength.

As shown in FIGS. 9 and 11, a pipe receiving hole 44 is formed in the center of the rotary member 40, in order to receive the support pipe 32 and the arm portion 3. A portion of the pipe receiving hole 44 which is close to its inlet is formed in a size corresponding to the diameter of the arm portion 3, while a portion beyond a step 44*a* is provided with a receiving hole which is in a size corresponding to the diameter of the support pipe 32. Thus, the arm portion 3 comes into contact with the step 44*a*, while the support pipe 32 which is received in the arm portion 3 is further inserted in a deeper portion.

Figure 12:
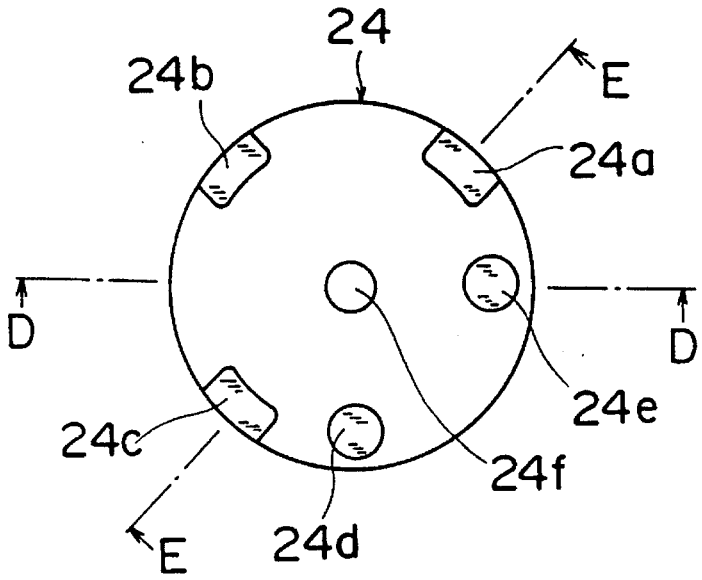
FIG. 12 is a side elevational view showing a stop plate provided on the arm mounting portion.
Figure 13:
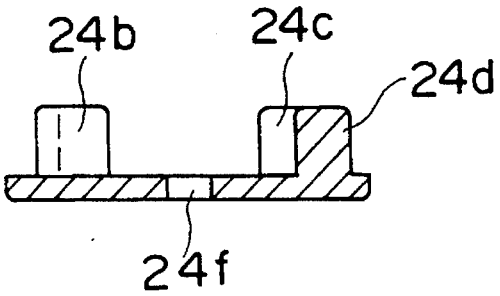
FIG. 13 is a sectional view taken along the line D—D in FIG. 12.
Figure 14:
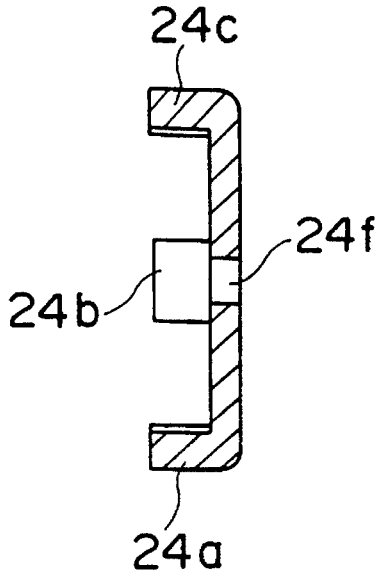
FIG. 14 is a sectional view taken along the line E—E in FIG. 12.

FIG. 12 is a side elevational view of the stop plate 24 as viewed from an inner side. FIG. 13 is a sectional view taken along the line D—D in FIG. 12, and FIG. 14 is a sectional view taken along the line E—E in FIG. 12. Referring to FIGS. 12 to 14, a through hole 24*f* is formed in the center of the stop plate 24 for passing the shaft 26 therethrough, while angular projections 24*a* to 24*c* and circular projections 24*d* and 24*e* are formed on its periphery to project toward the inner side.

Figure 15:
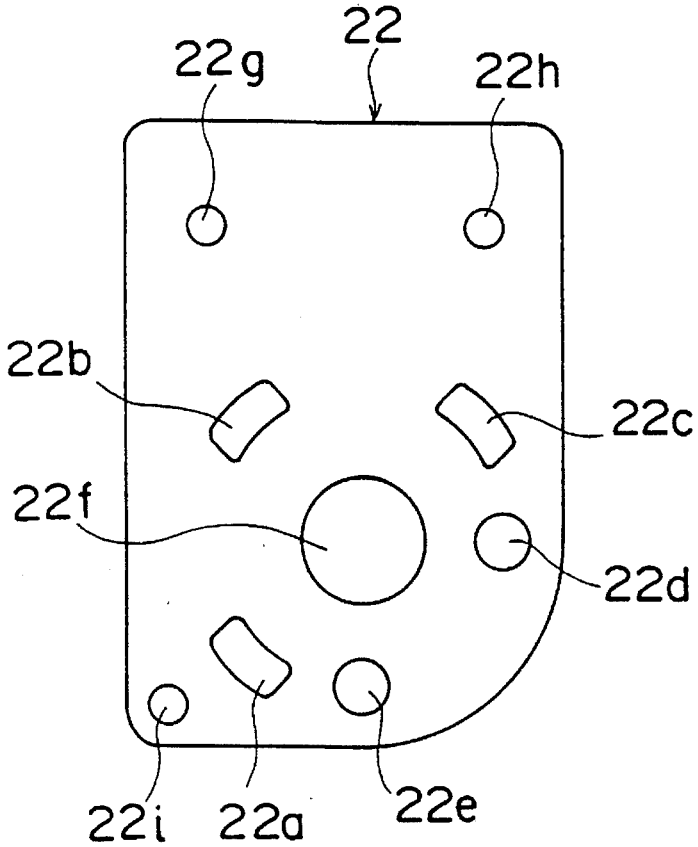
FIG. 15 is a side elevational view showing a case provided in the arm mounting portion.
Figure 16:
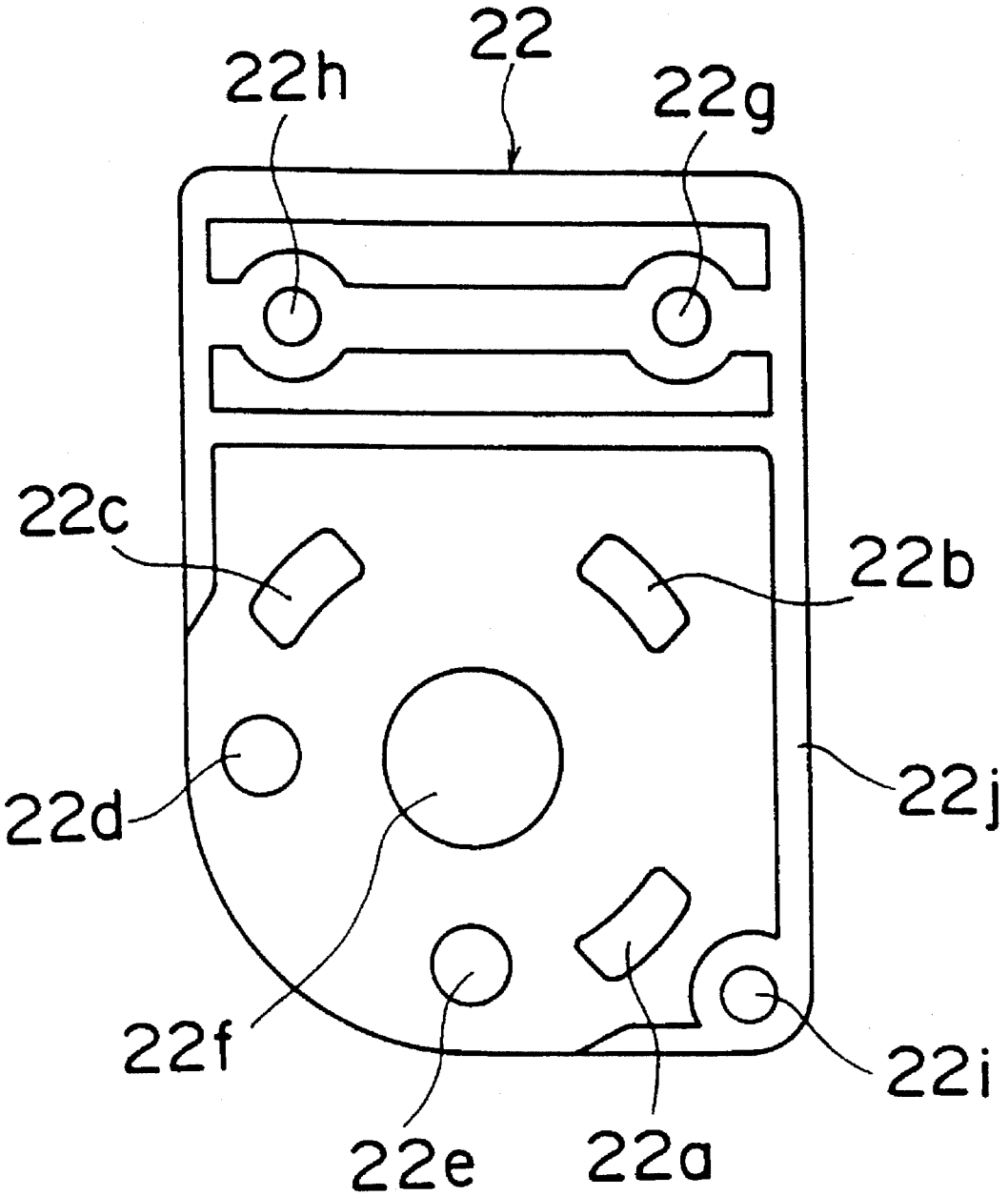
FIG. 16 is a side elevational view showing the case of FIG. 15 as viewed from a rear side.

FIG. 15 is a side elevational view showing the case 22, and FIG. 16 is a side elevational view of the case 22 as viewed from an inner side. Referring to FIGS. 15 and 16, through holes 22*g* and 22*h* are formed in an upper portion of the case 22, in order to pass the securing pins 34 and 35 fixing the support frame 33 for the chair portion 1 therethrough. Still another through hole 22*i* is formed under the through hole 22*g*, for passing the securing pin 36 therethrough. While the stop plate 24 is mounted on the case 22 as hereinabove described, through holes 22*a*, 22*b* and 22*c* and circular through holes 22*d* and 22*e* are formed in positions corresponding to the angular projections 24*a*, 24*b* and 24*c* and the circular projections 24*d* and 24*e* respectively. Further, a through hole 22*f* having a larger diameter is formed in a position corresponding to the through hole 24*f* which is formed in the center of the stop plate 24. The shaft 26 is passed through this through hole 22*f*, while the spring 28 which is provided around the shaft 26 is stored in this through hole 22*f*.

As shown in FIG. 7, the circular projection 24*e* of the stop plate 24 is passed through the through hole 22*e* which is formed in the aforementioned case 22, to be inserted in the stop hole 43*c* of the rotary member 40 provided in the interior. Thus, the respective projections of the stop plate 24 are inserted in the stop holes of the rotary member 40, thereby suppressing rotation of the rotary member 40 and positioning the same.

Figure 17:
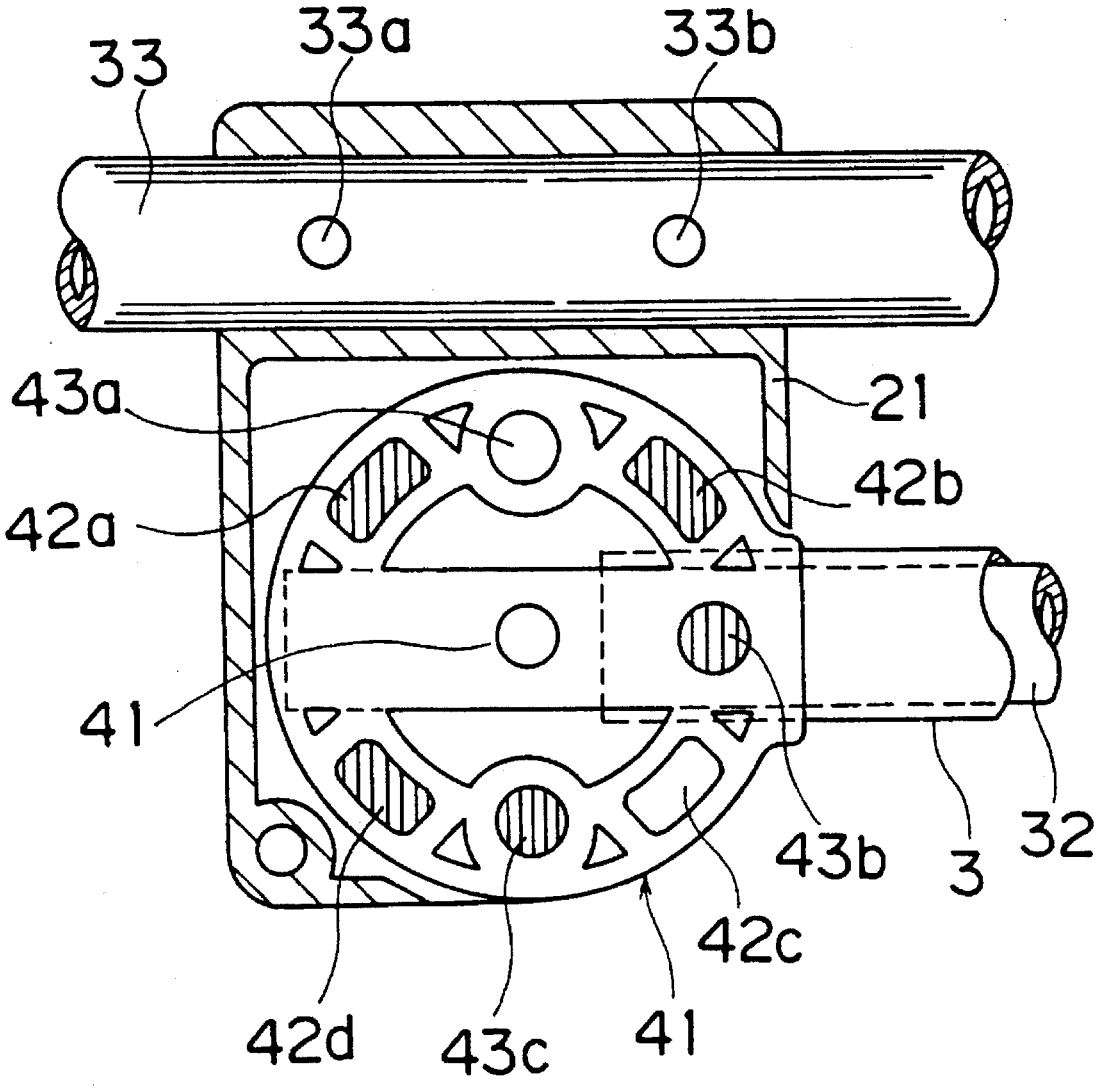
FIG. 17 is a side elevational view showing the rotary member in a state of the table chair which is used as such.

FIG. 17 illustrates a state of the rotary member 40 which is provided in the case 21. In the state shown in FIG. 17, the arm portion 3 is positioned in front of the chair portion 1, so that the table chair is used as such. Referring to FIG. 17, those of the stop holes provided in the rotary member 40 for receiving the projections of the stop plate 24 are shown in a hatched manner. In more concrete terms, the angular projections 24*a*, 24*b* and 24*c* and the circular projections 24*d* and 24*e* of the stop plate 24 are inserted in the angular stop holes 42*d*, 42*a* and 42*b* and the circular stop holes 43*b* and 43*c* of the rotary member 40 respectively. Thus, the rotary member 40 is inhibited from rotation and positioned, whereby the table chair can be used as such in a stably supported state.

Figure 18:
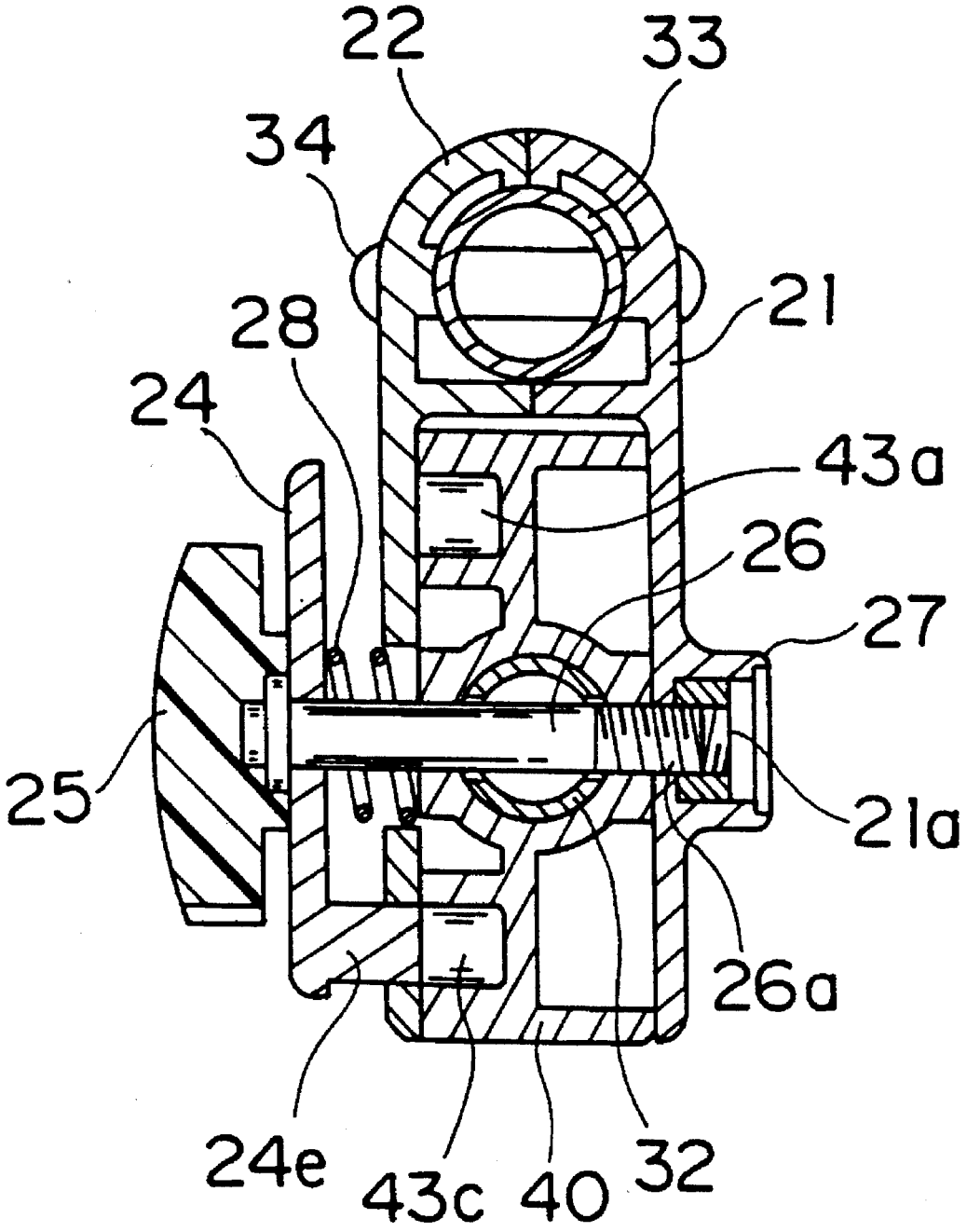
FIG. 18 is a sectional view showing the rotary member which is rotated by loosening a knob.

In order to use this table chair as a shoulder harness, the arm portion 3 must be rotated to be positioned under the chair portion 1. In this case, the knob 25 is rotated anticlockwise as shown in FIG. 18, to leftwardly move the shaft 26. The stop plate 24 which is leftwardly urged by the spring 28 is further leftwardly moved by such leftward movement of the knob 25, whereby the circular projection 24*e* of the stop plate 24 is disengaged from the circular stop hole 43*c* of the rotary member 40. The remaining projections are also disengaged from the corresponding stop holes, thereby allowing rotation of the rotary member 40. The arm portion 3 is rotated in this state, to be positioned under the chair portion 1.

Figure 19:
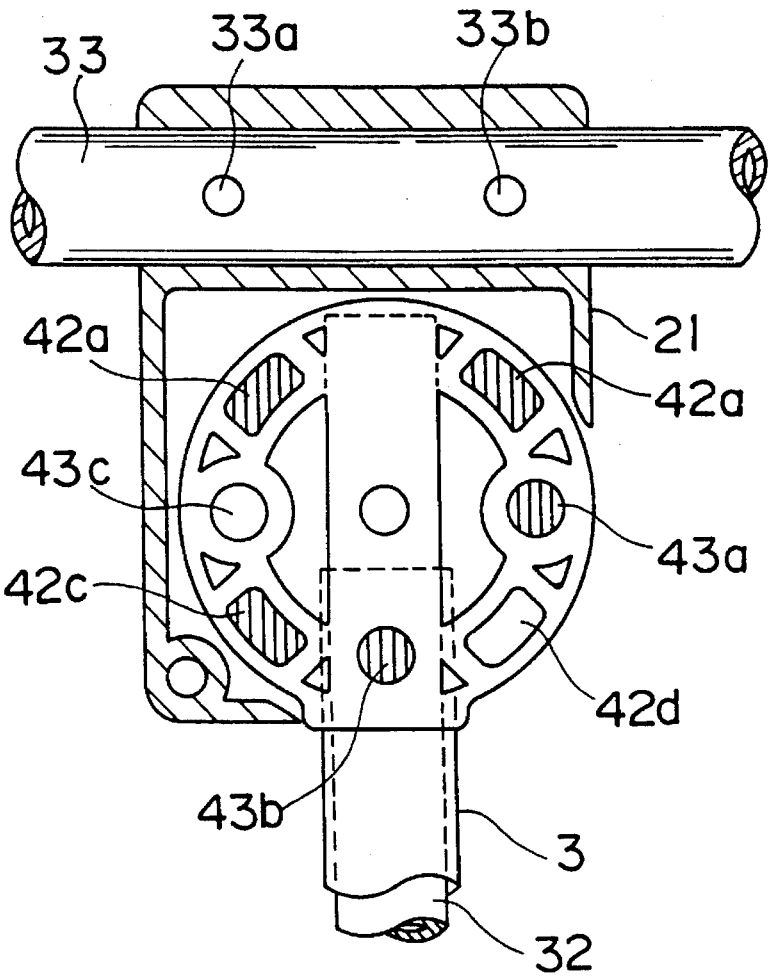
FIG. 19 is a side elevational view showing the rotary member in a state of the table chair which is used as a shoulder harness.

FIG. 19 shows the arm portion 3 which is rotated and positioned under the arm portion 1. In this state, the knob 25 is again rotated clockwise to move the stop plate 24 toward the rotary member 40, thereby inserting the respective projections of the stop plate 24 in the stop holes of the rotary member 40 and fixing the same. Referring to FIG. 19, those of the stop holes provided in the stop plate 24 for receiving the projections are shown in a hatched manner. Since the rotary member 40 is rotated by 90° from the state shown in FIG. 17, the positions of the stop holes receiving the projections are deviated. In more concrete terms, the angular projections 24*a*, 24*b* and 24*c* and the circular projections 24*d* and 24*e* of the stop plate 24 are inserted in the angular stop holes 42*c*, 42*d* and 42*a* and the circular stop holes 43*a* and 43*b* of the rotary member 40 respectively.

Thus, the projections of the stop plate 24 are so inserted in the stop holes of the rotary member 40 that the arm portion 3 can be fixed in respective states of the table chair used as such and as a shoulder harness, thereby attaining stably support states.

A mechanism for inwardly rotating the second arm 3*b* of the arm portion 3 is now described.

Figure 20:
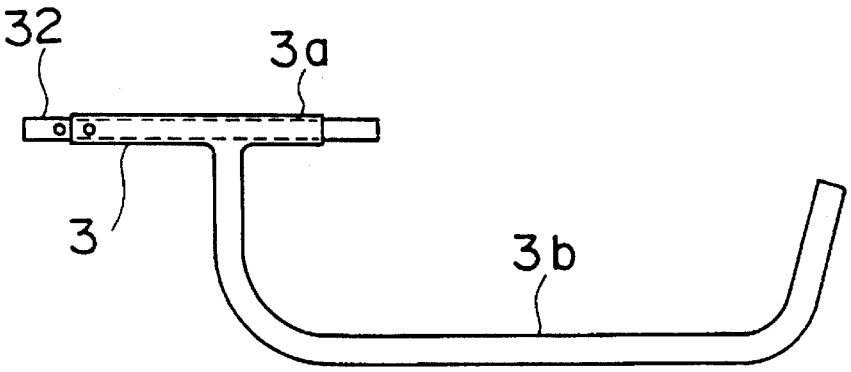
FIG. 20 is a side elevational view showing the relation between the arm portion and a support pipe.

As shown in FIG. 20, the support pipe 32 is passed through the arm portion 3. The support pipe 31 is also passed through the arm portion 2 in a similar manner. The following description is made only with respect to the arm portion 3.

Figure 21:
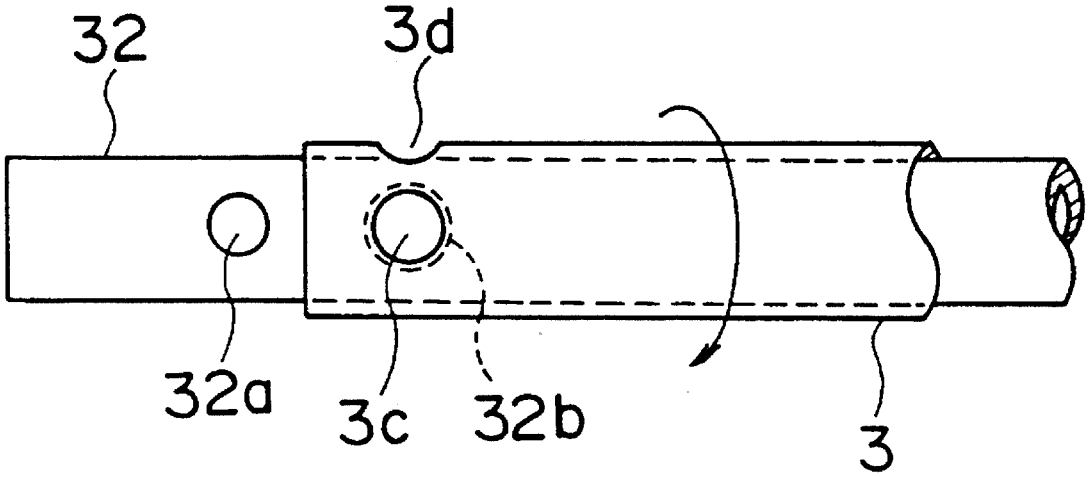
FIG. 21 is a side elevational view showing stop holes formed in the arm portion and the support pipe.

As shown in FIG. 21 in an enlarged manner, a through hole 32*a* is formed in an end portion of the support pipe 32. This through hole 32*a* is adapted to receive the shaft 26 which is provided on the center of the knob 25. A stop hole 3*c* is formed in a position of the arm portion 3 corresponding to each circular stop hole of the rotary member 40. Further, a stop hole 32*b* is also formed in a similar position of the support pipe 32 which is inserted in the arm portion 3. Each circular projection of the stop plate 24 is inserted in these stop holes 3*c* and 32*b*. Thus, the arm portion 3 is fixed in the position for attaining the state shown in FIG. 20.

When the knob 25 is rotated anticlockwise to extract the projection of the stop plate 24 from the stop holes 3*c* and 32*b* similarly to the above, the arm portion 3 can be freely rotated along arrow shown in FIG. 21. Thus, the arm portion 3 is rotated to inwardly position the second arm portion 3*b*.

Figure 22:
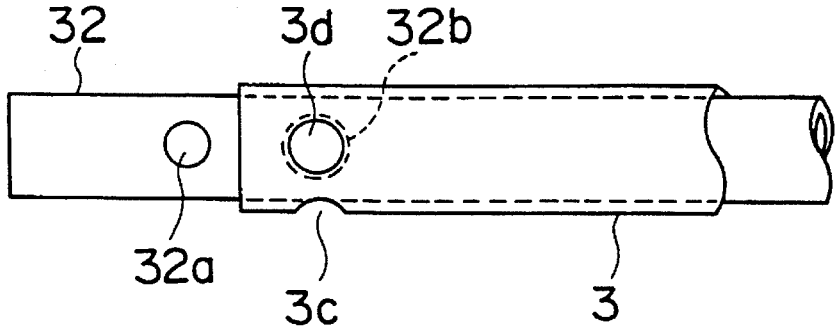
FIG. 22 is a side elevational view showing the stop hole of the support pipe, which is rotated for storing the arm portion, and that of the arm portion.

FIG. 22 shows the arm portion 3 which is rotated in the aforementioned manner. Due to such rotation, a stop hole 3*d* which is adjacent to the stop hole 3*c* overlaps with the stop hole 32*b* of the support pipe 32. In this state, the knob 25 is again rotated clockwise to insert the projection of the stop plate 24 in the stop holes 3*d* and 32*b*. Thus, it is possible to position and fix the arm portion 3 while inwardly bending the second arm 3*b*.

According to this embodiment, it is possible to use the table chair as such by moving and fixing the arm portions to and at the positions in front of the chair portion through the arm mounting portions. On the other hand, it is also possible to use the table chair as a shoulder harness by loosening the arm portions which are fixed to the arm mounting portions and moving and fixing the same to and at the positions under the chair portion.

Figure 23:
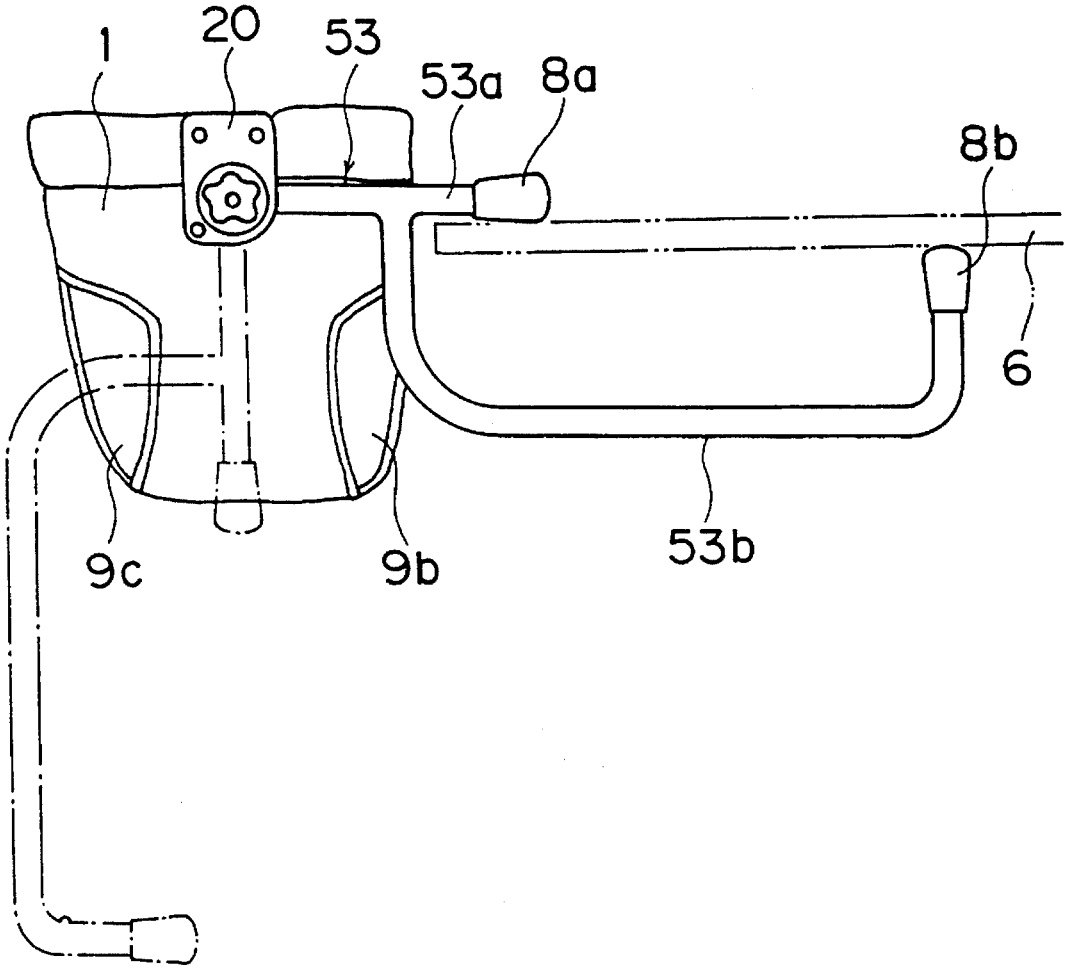
FIG. 23 is a side elevational view showing an embodiment according to the second aspect of the present invention.

FIG. 23 is a side elevational view showing an embodiment according to the invention described in claim 3. Similarly to the embodiment shown in FIG. 2, an arm mounting portion 20 is provided on an upper part of a chair portion 1, so that an end of an arm portion 53 is rotatably mounted on this arm mounting portion 20. A forward end of the arm portion 55 is divided into first and second arms 53*a* and 53*b*, which are provided with caps 8*a* and 8*b* on forward ends thereof respectively. Another arm portion (not shown) is also mounted on another arm mounting portion (not shown) on an opposite side of this figure. According to this embodiment, openings 9*b* and 9*c* are provided in front and rear surfaces of the chair portion 1 for passing the legs of a baby therethrough. Thus, it is possible to seat the baby in both of face-to-back and back-to-back states.

As shown in FIG. 23, it is possible to rotate the arm portion 53 about the arm mounting portion 20 to be positioned under the chair portion 1 and fix the same in this state, similarly to the embodiment shown in FIG. 2. The downwardly positioned state of the arm portion 53 is shown by one-dot chain lines in FIG. 23. According to this embodiment, the forward end of the second arm 53*b* is bent substantially at the right angle.

Figure 24:
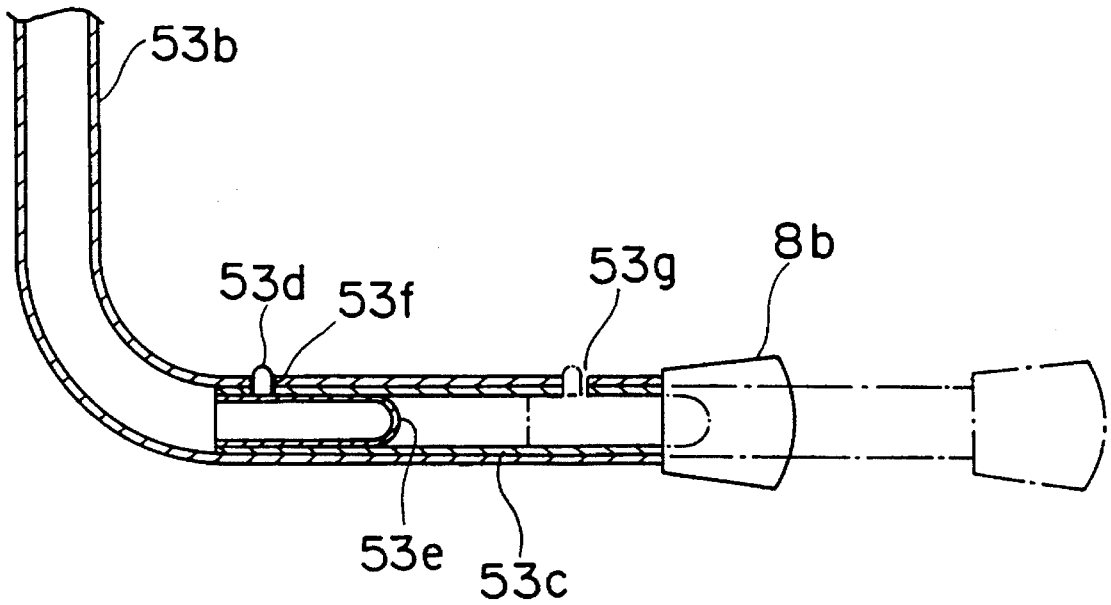
FIG. 24 is a sectional view showing a forward end of an arm portion provided in the embodiment shown in FIG. 23.

FIG. 24 is a sectional view showing the forward end of the second arm 53*b*. As shown in FIG. 24, an inner pipe 53*c* is inserted in the forward end of the second arm 53*b*, and a cap 8*b* is mounted on this inner pipe 53*c*. The inner pipe 53*c* is provided with a plate spring 55*e*, which is provided thereon with a lock pin 53*d*. This lock pin 53*d* is passed through a hole which is formed in the inner pipe 53*c*, to be inserted in a hole 53*f* which is formed in the forward end of the second arm 53*b*. The lock pin 53*d* is outwardly urged by the plate spring 53*e*. Thus, the lock pin 53*d* which is inserted in the hole 53*f* provided in the forward end of the second arm 53*b* is adapted to lock the inner pipe 53*c* in its position.

In order to stand up the table chair according to this embodiment by the arm portion 53 thereby using the same as a shoulder harness, the lock pin 53*d* is downwardly pressed and the cap 8*b* is grasped to extract the inner pipe 53*c*. The lock pin 53*d* is inwardly forced against the urging force of the plate spring 53*e*, whereby the inner pipe 53*c* is extracted and moved in this state. Reaching the position of a hole 53*g* which is formed in a forward end portion of the second arm 53*b*, the lock pin 53*d* which is outwardly urged by the plate spring 53*e* is inserted in this hole 53*g*, thereby locking, positioning and fixing the inner pipe 53*c*. FIG. 24 shows this state in one-dot chain lines.

Thus, it is possible to stand up the table chair through the arm portion 53 by further extending the forward end of the second arm 53*b*. When the angle for bending the arm portion 53 is properly adjusted so that the forward end of this arm portion 53 can be further extended, it is possible to stand up the table chair while seating the baby on the chair portion 1. This state is extremely convenient for carrying the baby on the user's back or putting it down. Further, it is possible to use the table chair as a chair which is set on the floor.

In each of the first and second aspects of the present invention, the arm mounting portions are not restricted to the aforementioned structure so far as the same can position and fix the arm portions in the states of the table chair used as such and as a shoulder harness.

In the second aspect of the present invention, the arm portions are not restricted to the aforementioned structure having forward ends which are extended to stand up the table chair, so far as the table chair can be stood up in a state for serving as a shoulder harness.

While the arm portions are so rotated that the second arms are inwardly positioned for storage, the present invention is not restricted to such a rotating structure of the arm portions.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A baby table chair being usable as a shoulder harness, comprising:

a chair portion for seating a baby thereon;

an arm portion having an end being mounted on said chair portion for supporting said chair portion;

a shoulder belt having an end being mounted on said chair portion and another end being mounted on said arm portion;

an arm mounting portion for mounting said end of said arm portion on said chair portion, said arm mounting portion being capable of rotatably supporting said arm portion for implementing a state of positioning said arm portion in front of said chair portion for using said table chair as such by holding a table with said arm portion and a state of positioning said arm portion under said chair portion for using said table chair as a shoulder harness, as well as positioning and fixing said arm portion in positions for implementing said two states respectively;

there being a pair of said arm portions and a pair of said arm mounting portions respectively, each of said arm portions being formed by first and second arms respectively so that said first arms are positioned on said table and said second arms are positioned under said table in said state of said table chair being used as such; and for each of said arm portions, said first and second arms thereof being in a fixed relationship with respect to each other whereby they move together as a unitary structure while said arm portion formed thereby is pivoted.

2. A baby table chair in accordance with claim 1, wherein said second arms are provided to be inwardly rotatable about said first arms as a center, said table chair being foldable by inward rotation of said second arms.

3. A baby table chair in accordance with claim 1, capable of being stood up by said arm portion in a state being used as a shoulder harness.

4. A baby table chair in accordance with claim 1, wherein pipes are inserted in forward ends of said second arms so that said pipes are extracted to extend said forward ends of said second arms and to bring the same into contact with the floor, thereby standing up said table chair.

5. A baby table chair in accordance with claim 1, wherein said another end of said shoulder belt is mounted on said second arms of said arm portions.

* * * * *